US006191529B1

(12) United States Patent
Park

(10) Patent No.: US 6,191,529 B1
(45) Date of Patent: Feb. 20, 2001

(54) APPARATUS FOR REMOVING IMPURE GASES FROM GAS DISCHARGE DISPLAY APPARATUS

(75) Inventor: Hun-Gun Park, Seoul (KR)

(73) Assignee: LG Electronics Inc., Seoul (KR)

( * ) Notice: Under 35 U.S.C. 154(b), the term of this patent shall be extended for 0 days.

(21) Appl. No.: 09/322,930

(22) Filed: Jun. 1, 1999

(30) Foreign Application Priority Data

Jun. 1, 1998 (KR) ..... 98-20218

(51) Int. Cl.[7] ..... H01J 17/24
(52) U.S. Cl. ..... 313/553; 313/562; 313/560
(58) Field of Search ..... 313/553, 561, 313/562, 560, 563

(56) References Cited

U.S. PATENT DOCUMENTS 3,947,713 * 3/1976 Przyblek ..... 313/562
4,072,975 * 2/1978 Ishitani .
5,977,706 * 11/1999 Cho et al. ..... 313/561 X

* cited by examiner

*Primary Examiner*—Ashok Patel
(74) *Attorney, Agent, or Firm*—Fleshner & Kim, LLP

(57) ABSTRACT

An apparatus for removing impure gases from a gas discharge display apparatus is disclosed, which includes a getter engaged at an outer portion of an image effective portion of the vacuum space for absorbing an impure gas, and a blocking wall for preventing the getter from being scattered toward the image effective portion in a gas discharge display apparatus in which a certain space is formed between a pair of substrates, and the substrates are sealed by a sealant, and a combined gas which is used for an electrode discharge is filled into a vacuum space formed between the substrates after an impure gas is exhausted therefrom by a ventilation/vacuum process, for thereby enhancing an image characteristic by preventing a getter material from being scattered toward an image display surface.

8 Claims, 3 Drawing Sheets

APPARATUS FOR REMOVING IMPURE GASES FROM GAS DISCHARGE DISPLAY APPARATUS

BACKGROUND OF THE INVENTION

1. Field of the Invention

The present invention relates to a gas discharge display apparatus, and in particular to an apparatus for removing impure gases from a gas discharge display apparatus which makes it possible to continuously remove impure gases which are continuously generated in the interior of the apparatus during a fabrication of a display apparatus capable of displaying a certain image based on a gas discharge.

2. Description of the Background Art

FIGS. 1 and 2 illustrates an example of a PDP(Plasma Display Panel) which is one of a conventional gas discharge display apparatus.

As shown therein, the PDP is formed of a structure in which two substrates, namely, a front substrate 1 and a back substrate 2 which are installed at a certain interval therebetween for displaying a certain image based on a gas discharge. The two substrates 1 and 2 are bonded using a frit sealant after a predetermined number of elements are installed on the front and back substrates 1 and 2, and then a gas exhalation and vacuum process are sequentially performed for thereby completing a fabrication of the PDP.

With the thusly constituted structure, when a power is applied to the PDP system, the movements of the electrons in discharge cells are accelerated by a driving voltage applied thereinto, and then the electrons collide with an inactive gas filled at a pressure of 300~700 Torr. At this time, as the inactive gas is excited, an ultraviolet ray of 147 nm is generated. The thusly generated ultraviolet ray collides with a fluorescent material in a discharge space for thereby emitting a visible ray, thus implementing a certain color image at an image effective portion "a".

In the conventional PDP, the inner space formed between the front and back substrates into which a combined gas is supplied must have a vacuum state of $10^{-6}$~$10^{-8}$ for thereby implementing a certain operation of the PDP system.

The above-described vacuum state is implemented by removing an impure gas existing in the interior of the system and then filling a combined gas thereinto. Thereafter, the sealing process is performed. In order to implement the above-described processes, it takes about 10~20 hours. Therefore, the fabrication time is increased for thereby decreasing the productivity.

In addition, after implementing a vacuum state based on the sealing process, a certain impure gas is continuously generated in the interior of the system during the operation of the PDP system, so that the vacuum characteristic is decreased. The above-described problem may cause a discharge error and discharge voltage increase between the electrodes.

In order to overcome the above-described problems, a getter structure is disclosed for a second flexing process after a first vacuum process is performed. Namely, a getter may be installed in a getter space formed at an upper portion of a ventilation tube inserted into a hole formed at a substrate for implementing a ventilation/vacuum operation, and a sheet getter which is more easily attachable may be attached at an outer side of an image effective portion "a" in the vacuum space between the front and back substrates for thereby removing an inner impure materials.

However, in the above-described getter structure, when mounting the getter in the getter space formed at an upper portion of the ventilation tube, a certain heat must be transferred to the getter before the substrates are sealed for thereby scattering of the getter, so that it is impossible to remove the impure gases generated in the interior of the PDP system after the system is sealed.

In addition, in the case that a sheet getter is provided in the vacuum space, it is impossible to transfer a certain heat in order to scatter the getter. Even when the getter is scattered, a getter material may be scattered to the image effective portions on which an image is displayed, so that the effective screen of the front substrate 1 may be damaged.

SUMMARY OF THE INVENTION

Accordingly, it is an object of the present invention to provide an apparatus for continuously removing impure gases which are generated in the interior of a system by effectively scattering a getter material provided in a vacuum after a gas discharge display apparatus is sealed and during an operation of a display apparatus.

It is another object of the present invention to provide an apparatus for removing impure gases from a gas discharge display apparatus which is capable of enhancing an image characteristic by preventing a getter material from being scattered toward an image display surface.

To achieve the above object, there is provided an impure gas removing apparatus for a gas discharge display apparatus which includes a getter engaged at an outer portion of an image effective portion of the vacuum space for absorbing an impure gas, and a blocking wall for preventing the getter from being scattered toward the image effective portion in a gas discharge display apparatus in which a certain space is formed between a pair of substrates, and the substrates are sealed by a sealant, and a combined gas which is used for an electrode discharge is filled into a vacuum space formed between the substrates after an impure gas is exhausted therefrom by a ventilation/vacuum process.

Preferably, the getter contacts with an electrode to implement an activation and scattering operation when an external voltage is applied.

The getter is attached on one side of the substrate in a sheet shape.

The blocking wall is formed at the image effective portion and is formed of the same material as a partition formed to separate discharge pixels.

The blocking wall has the same height as a distance between the front and back substrates and is closely attached to each of the front and back substrates.

The blocking wall has a height smaller than a distance between the front and back substrates and is a fixed to one side of the substrates.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The embodiments of the present invention will be explained with reference to the accompanying drawings.

Figure 1:
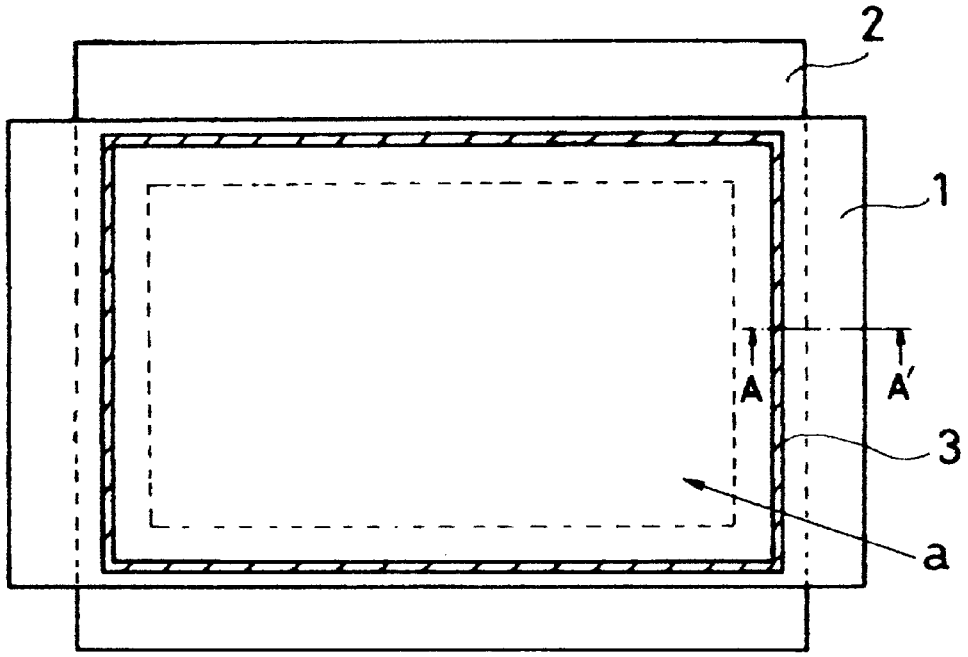
FIG. 1 is a rear view illustrating an engagement of substrates of a conventional display apparatus.
Figure 2:
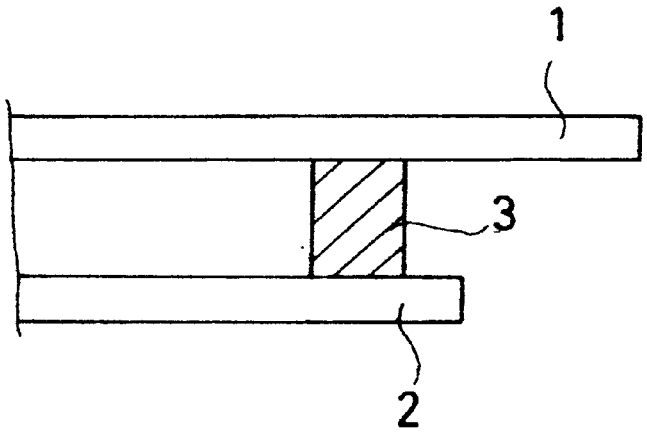
FIG. 2 is a cross-sectional view taken along line A-A' of FIG. 1.
Figure 3:
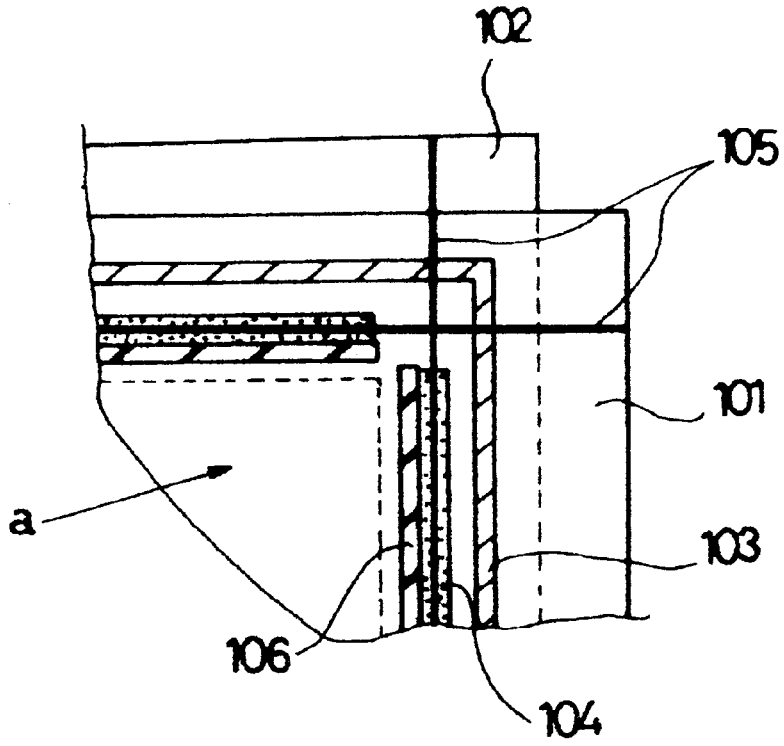
FIG. 3 is a view illustrating substrates to which a getter is adapted according to the present invention.
Figure 4A:
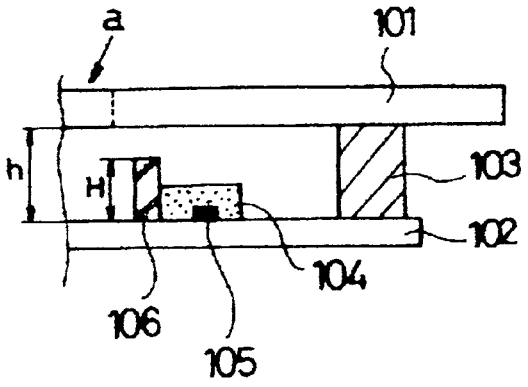
FIG. 4A is a cross-sectional view before a getter is scattered in a getter structure according to the present invention.
Figure 4B:
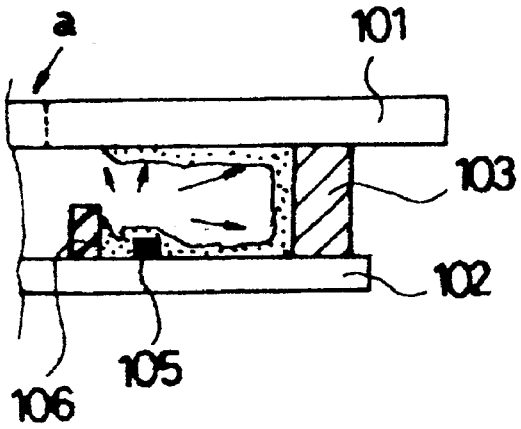
FIG. 4B is a cross-sectional view after a getter is scattered in a getter structure according to the present invention.

FIG. 3 illustrates a corner portion of a substrate having an impure gas removing apparatus according to the present invention, and FIG. 4A illustrates one side of a substrate before an impure gas removing apparatus is operated, and FIG. 4B is a cross-sectional view after an impure gas removing apparatus is operated.

A sheet getter 104 is attached at an outer portion of an image effective portion "an" which is a region that an image is displayed on a screen among the inner spaces of a front substrate 101 and a back substrate 102 which are engaged in parallel by a frit sealant 103 which is one of the known sealants, and an electrode 105 is installed at a lower portion of the sheet getter 104 for receiving an external power for transferring a scattering heat for an active heat for implementing a getter scattering operation.

A blocking wall 106 is formed at the side of the image effective portion "a" of the sheet getter 104 in order to prevent the getter materials from being scattered toward the image effective portion "a" and has a certain height.

In the present invention, the sheet shape getter is used for the purpose that a certain distance of 100~200 $\mu$m is formed between the front surface 101 and the back substrate 102, and the maximum surface area is implemented. In addition, the sheet shape getter may be implemented by a known printing technique.

The blocking wall 106 may be formed of the same material as a partition (not shown) formed to define a discharging space between the discharging cells at the side of the image effective portion "a" or may be formed of the same seal material as the frit sealant 103. Therefore, the existing materials may be used when fabricating the system, so that it is possible to increase the productivity.

In addition, the height "H" of the blocking wall 106 is smaller than the distance "h" between the substrates 101 and 102. Therefore, it is possible to remove an impure gas generated by the frit sealant 103 as well as an impure gas generated by the construction at the side of the image effective portion "a" when the getter is scattered.

The operation of the impure gas removing apparatus according to the present invention will be explained with reference to FIGS. 4A and 4B.

The substrates 101 and 102 of the PDP formed via the above-described processes are engaged, and a gas is externally exhausted from the space formed between the substrates 101 and 102, so that a vacuum process is performed.

During the vacuum process, as shown in FIG. 4A, a voltage is supplied to the electrode 105 contacting with the sheet getter 104, the sheet getter 14 is heated and then is scattered at a certain temperature.

At this time, the scattering of the getter material is blocked from being scattered toward the image effective portion "a" as shown in FIG. 4B by the blocking wall 106. Namely, the scattering operation is performed at the side of the sealant 103, and the substrates 101 and 102 and the frit sealant 103 are bonded.

The thusly scattered getter blocks an impure gas which is generated in the inner structure such as the sealant 104, so that the amount of the impure gas which is moved toward the image effective portion "a" is minimized, and the voltage increase between the discharge electrodes due to the impure gas is prevented, and the driving voltage may be dropped.

In the above-described scattering operation of the getter, the impure gas which is generated at the inner structure during the operation of the PDP is continuously absorbed and blocked by applying an external voltage to the electrode 105 after sealing the substrates after the inner vacuum process and the gas insertion process are performed.

Figure 5:
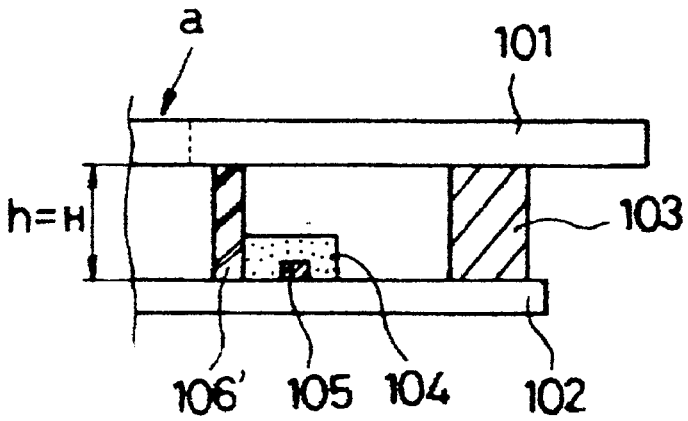
FIG. 5 is a cross-sectional view illustrating a getter structure according to the present invention.

FIG. 5 illustrates the structure according to another embodiment of the present invention. As shown therein, the height "H" of the blocking wall 106' is the same as the distance "h", and the blocking wall 106' is engaged to the front substrate 101 and the back substrate 102, respectively.

Namely, since the impure gas is mainly generated at the frit sealant 103, in a state that the image effective portion "a" is not affected in the structure of the blocking wall 106', the getter 104 is scattered, so that the impure gas generated at the sealant is effectively gathered.

In the conventional art, it takes about 10~20 hours for implementing a vacuum state between the substrates, and it is impossible to effectively remove the impure gas from the interior after the substrates are sealed. However, in the present invention, it is possible to scatter the getter by supplying an external voltage during the ventilation of the inner gas or after the substrates are sealed, so that a vacuum state is easily implemented.

Therefore, in the present invention, it is possible to continuously absorb the impure gas which is generated in the interior of the display apparatus which uses a gas discharge for thereby increasing the discharge efficiency in the vacuum space.

As described above, in the getter structure according to the present invention, it is possible to effective remove the impure gas which is generated at the structure such as the sealant, etc. by applying an external voltage when fabricating the gas discharge display apparatus, and it is possible to prevent the getter from being scattered toward the effective screen, so that the increase of the voltage is increased, and the life time of the product is increased for thereby enhancing the reliability of the product.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. In a gas discharge display apparatus in which a certain space is formed between a pair of substrates, and the substrates are sealed by a sealant, and a combined gas which is used for an electrode discharge is filled into a vacuum space formed between the substrates after an impure gas is exhausted therefrom by a ventilation/vacuum process, an impure gas removing apparatus for a gas discharge display apparatus, comprising:

a getter engaged at an outer portion of an image effective portion of the vacuum space for absorbing an impure gas; and a blocking wall for preventing the getter from being scattered toward the image effective portion.

2. The apparatus of claim 1, wherein said getter contacts with an electrode to implement an activation and scattering operation when an external voltage is applied.

3. The apparatus of claim 1, wherein said getter is attached on one side of the substrate in a sheet shape.

4. The apparatus of claim 1, wherein said blocking wall is formed at the image effective portion and is formed of the same material as a partition formed to separate discharge pixels.

5. The apparatus of claim 1, wherein said blocking wall is formed of the same material as the sealant which bonds the front and back substrates.

6. The apparatus of claim 1, wherein said blocking wall has the same height as a distance between the front and back substrates and is closely attached to each of the front and back substrates.

7. The apparatus of claim 1, wherein said blocking wall has a height smaller than a distance between the front and back substrates.

8. The apparatus of claim 1, wherein a plurality of said blocking walls each having a certain length are provided.

* * * * *